United States Patent [19]

Kochanowski

[11] 4,377,200

[45] Mar. 22, 1983

[54] APPARATUS FOR RECOVERING WASTE HEAT FROM EXHAUST GAS FLOWING THROUGH AN EXHAUST PIPE

[76] Inventor: George A. Kochanowski, 1640 S. Surrey La., Lake Forest, Ill. 60045

[21] Appl. No.: 23,148

[22] Filed: Mar. 23, 1979

[51] Int. Cl.[3] ..... F28F 3/12

[52] U.S. Cl. ..... 165/76; 165/169; 165/DIG. 12; 29/157.3 C

[58] Field of Search ..... 165/154, 164, 168, 169, 165/171, 183, 184, 185, 76, DIG. 12; 29/157.3 C; 113/118 C, 118 R; 138/115, 116, 117, 112, 170, 171

[56] References Cited

U.S. PATENT DOCUMENTS

| | | | |
|---|---|---|---|
| 2,190,288 | 2/1940 | Higham | 165/168 |
| 3,448,798 | 6/1969 | Coe | 29/157.3 C |
| 3,512,581 | 5/1970 | Lawton | 165/164 |
| 3,739,147 | 6/1973 | Mayhew et al. | 165/185 |

FOREIGN PATENT DOCUMENTS

| | | | |
|---|---|---|---|
| 730114 | 12/1942 | Fed. Rep. of Germany | 165/169 |
| 829103 | 2/1960 | United Kingdom | 165/164 |
| 1081889 | 9/1967 | United Kingdom | 138/112 |

*Primary Examiner*—William R. Cline
*Attorney, Agent, or Firm*—Samuel Kurlandsky

[57] ABSTRACT

An apparatus for recovering waste heat from a hot exhaust pipe and utilizing the heat to warm water passing through the apparatus, which comprises a plurality of thermal conduction members each longitudinally positioned in contact with said exhaust pipe, the plurality of conduction members being arranged circumferentially about the exhaust pipe, each of the thermal conduction members having a surface which is concavely arcuate in cross-section and of substantially the same curvature as that of the exhaust pipe and in contact engagement therewith.

The thermal conduction members each have a longitudinal channel with a bottom of arcuate cross-section and a pair of spaced-apart longitudinally extending fins.

A water pipe is positioned in the bottom of the channel of substantially the same arcuate cross-section as the bottom surface of the channel. The fins are bent or crimped over the pipe and placed in contact engagement with surface of the pipe. A plurality of U-shaped pipes each connect the ends of adjacent water pipe cooperating to provide a continuous water conduit having means at one end adapted to be connected to a water source, and having outlet means at the other end connected to the water inlet of an apparatus such as a water heater.

5 Claims, 3 Drawing Figures

APPARATUS FOR RECOVERING WASTE HEAT FROM EXHAUST GAS FLOWING THROUGH AN EXHAUST PIPE

BACKGROUND OF THE INVENTION (1) Field of the Invention

The present invention relates to the field of recovering waste heat, and is more particularly concerned with an apparatus for recovering waste heat from the exhaust pipe of an apparatus such as a water heater and utilizing the heat to warm influent water supplied to the apparatus.

(2) Prior Art

Some attempts have been made to recover heat from an exhaust pipe or chimney and to utilize the heat for a useful purpose. However, these attempts have not been entirely successful, as they have been both inefficient and expensive to fabricate.

SUMMARY OF THE INVENTION

It is accordingly an object of the present invention to provide an apparatus for recovering waste heat.

It is a further object to provide an apparatus of the type described which is adapted to be mounted around a hot exhaust pipe carrying waste combustion gases.

It is a further object to provide an apparatus of the type described which is particularly adapted to be mounted on the exhaust pipe of a water heater, and to recover waste heat from the combustion gases carried by the exhaust pipe of the water heater and to utilize the recovered heat to preheat the influent water applied to the water heater.

It is a further object to provide an apparatus of the type described which is efficient and which is relatively inexpensive to fabricate.

Other objects and advantages of the present invention will become apparent from the following description and from the drawing.

An apparatus according to the invention is provided in the form of a plurality of thermal conduction members placed longitudinally with respect to the exhaust pipe of the water heater and distributed circumferentially around the pipe, the conduction members having a surface contoured for close contact engagement with the exhaust pipe. Each conduction member is provided with a longitudinal channel having an arcuate bottom and a water pipe mounted in the channel in contact engagement with the arcuate bottom. Fins are provided as part of the channel and are bent completely around the pipe and in close contact engagement therewith. The ends of adjacent pipes are connected together to form a water conduit through which influent water to the water heater is conducted, the recovered heat from the exhaust pipe being conducted to the water conduit and preheating the water prior to its induction into the water heater. As a result, because the water entering the water heater is warmer than the water taken from the water source, a substantial saving in fuel is accomplished.

BRIEF DESCRIPTION OF THE PREFERRED EMBODIMENT

Figure 1:
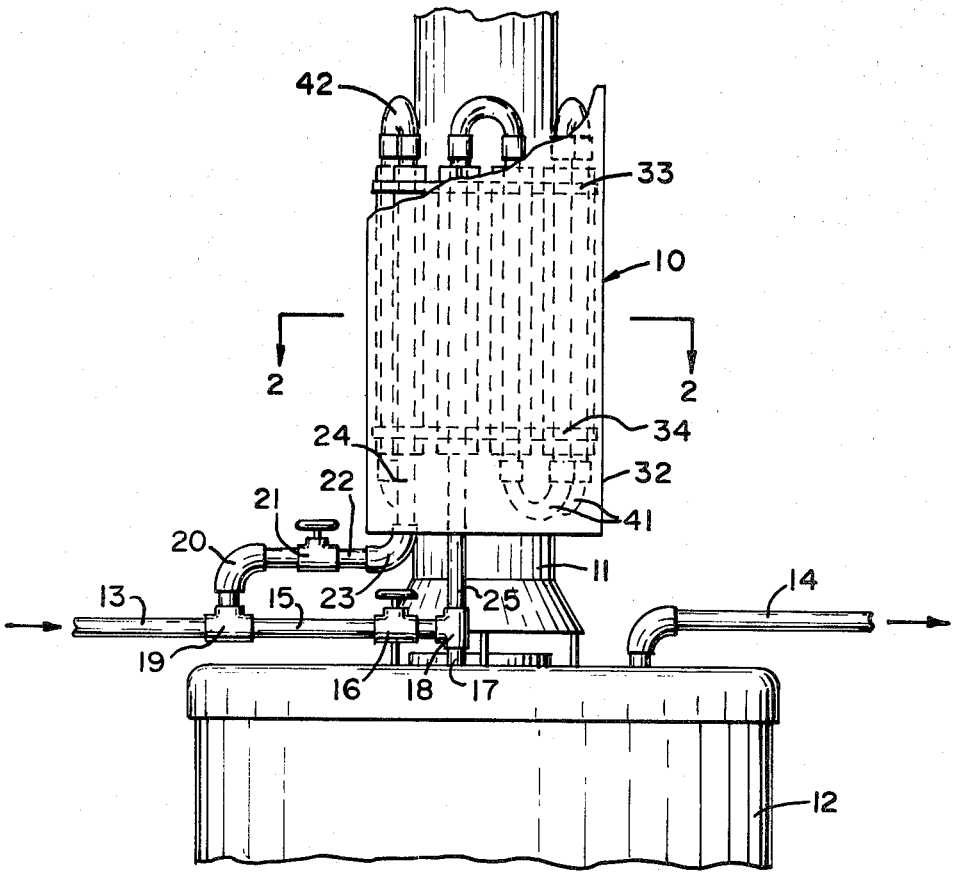
FIG. 1 is an elevational view showing the top portion of a conventional water heater having the apparatus according to the invention mounted thereon surrounding the exhaust pipe.

Referring to FIG. 1, a waste heat recovery assembly 10 is shown mounted on an exhaust pipe 11 of a water heater 12. A water source inlet pipe 13 conducts water to the assembly, and a hot water discharge pipe 14 conducts water out of the heater. A water by-pass pipe 15 is connected to a valve 16 to a water heater inlet 17 through a T-coupling 18. The inlet pipe 13 is connected to a T-coupling 19, through an elbow 20, a second valve 21, a nipple 22, and an elbow 23 and to the water conduit 24 of the heat recovery assembly 10. The other end of the water conduit 24 is connected to the water heater inlet pipe 25.

Figure 2:
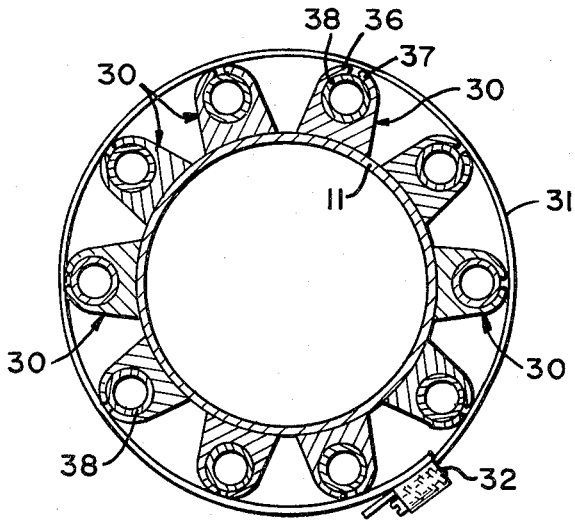
FIG. 2 is a cross-sectional view taken at the line 2—2 of FIG. 1, looking in the direction of the arrows.

Referring to FIG. 2, the waste heat recovery assembly 10 of the present invention is shown in cross-section and comprises a plurality of thermal conduction members 30 mounted longitudinally along the exhaust pipe 11 of the water heater 12. An outer jacket 31 of a thin metal or other material is placed around the thermal conduction members to prevent heat from radiating outwardly. An adjustable screw clamp 32 clamps the jacket 39 tightly about the conduction members 30.

Figure 3:
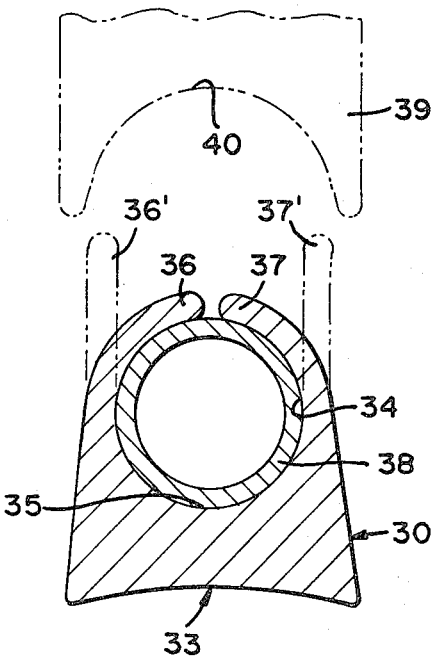
FIG. 3 is a cross-sectional view of a thermal conduction member, showing the fins before and after they have been bent over the included water pipes and showing in broken lines a fragmentary elevational view of a tool utilized for crimping the fins into position.

Referring to FIG. 3, a cross-section of a thermal conduction member 30 is shown together with associated structure. The bottom portion of the conduction member has a surface 33 which is concavely arcuate in cross-section and has a cylindrical contour along its length. The curvature is substantially the same as that of the exhaust pipe 11, so that when the conduction member is placed longitudinally along the surface of the pipe 11, there is intiminate contact engagement between the surface 33 of the conduction member and the surface of the exhaust pipe 11 along the entire length of the conduction member.

At the upper edge of the thermal conduction member 30 is a channel 34 having a bottom 35 which is partially circular in cross-section. As initially extruded the channel is defined by a pair of upwardly extending fins 36' and 37' shown in broken lines. A copper water pipe 38 is positioned in the channel 34 and is chosen to have substantially the same curvature as the bottom 35 of the channel. In order that the pipe make good contact engagement with the channel, After the water pipe has been placed within the channel, the fins 36' and 37' are bent over or swaged until they are in contact engagement with pipe 38, as designated by the numerals 36 and 37. The resulting structure provides excellent thermal conductivity between the thermal conduction member 30 and the pipe 38. A die 39 is shown in broken lines having an arcuate die surface 40 suitable for proper swaging of the fins 36' and 37' over the pipe by the application of proper force.

As shown in FIGS. 1 and 2 a plurality of thermal conduction members 30 having water pipes 38 engaged in the channels thereof are disposed circumferentially around the exhaust pipe 11, the conduction members each being disposed longitudinally with respect to the pipe. A continuous water conduit 24 is formed, as shown in FIG. 1, by means of U-shaped connection tubes 41 and 42 which are connected to the water pipes 38 by suitable means such as soldering each U-shaped tube connecting the ends of adjacent pipes to form the single duct which is connected at on end to the water source 13 and at the other end to the water heater inlet pipe 25. Alternatively a continuous integral tube may be used and bent to permit insertion in the thermal conduction members 30.

In constructing the apparatus of the present invention, a length of the member material having the desired contours is extruded from material such as aluminum. The long extrusion pieces are then cut to the proper length by means such as sawing. Copper water pipes 38 are then placed in the channels 34 and a tool 39 mounted in a press is then used to crimp or swage the fins 36' and 37' over in contact engagement with the pipe 38. A plurality of conduction members having water pipes are then placed with the arcuate surface 33 in engagement with the exhaust pipe surface. The conduction members are oriented longitudinally with respect to the pipe 11, and a group of conduction members are place circumferentially around the pipe. U-shaped connection tubes are soldered to the ends of adjacent water pipes to form a water conduit 24 which is connected at one end to the water inlet and at the other end to the inlet to the water heater. Alternatively a single tube may be suitably bent and inserted into the channels 34 to form an integral conduit. The thermal conduction members are distributed circumferentially around the exhaust pipe 11 with their arcuate surfaces in close contact engagement with the surface of the pipe. The entire structure may be held in engagement with the pipe by means of straps 43 and 44 placed around the assembly. Additionally, as shown, an outer jacket of sheet metal may be placed around the entire assembly to limit radiation of heat. The jacket 31 is maintained in place by adjustable screw clamps 32.

In operation, the influent water enters pipe 13, the valve 16 is closed and the valve 21 opened, thereby conducting water into the conduit system. If desired a portion of the water may be bypassed and introduced directly into the water heater by leaving the valve 16 partially open. The water which has circulated through the conduit leaves the system through pipe 25 and into the water heater influent pipe 47. The water entering the water heater has preheated by the heat recovered from the exhaust pipe to a temperature substantially above that of the water source from the main. Consequently, less fuel is used for bringing the preheated water to the desired hot water temperature by the water heater, resulting in a substantial savings in gas or oil fuel.

The heat recovery apparatus of the present invention has many advantages over devices of the prior art. The thermal conduction members may be readily fabricated by extruding aluminum into long extrusions having the desired cross-section. Individual members are then cut or sawed from the stock extrusions to any desired length. By the extrusion method it is relatively easy to provide the arcuate bottom surface with the proper curvature for good contact engagement with conventional exhaust pipes or other heat conducting devices. With a properly designed extrusion die both the arcuate surface 33 and the channel 34 may be simultaneously formed. The curvature of the bottom of the channel is designed with the proper circular curvature so that standard size water pipes may be inserted therein. The fins 36' and 37' are then swaged over the pipe to form a tight contact engagement by means of the tool 39, as shown in FIG. 3. The conduction members and pipes may all be cut to proper size to accommodate the length of the gas heater exhaust pipe. A plurality of units are then placed around the pipe and the U-shaped connecting tubes are soldered to the ends of the water pipes to form a single continuous conduit. The structure is relatively inexpensive and quite efficient, and results in a substantial savings in fuel cost.

Although the present invention has been shown in an embodiment for preheating influent water to a water heater, the invention has many more applications.

It is to be understood that the invention is not to be limited to the exact details of composition, materials or operation as shown or described, as obvious modifications and equivalents will be apparent to one skilled in the art without departing from the spirit or scope of the invention.

Invention is claimed as follows:

1. An assembly for mounting about a duct of arcuate cross-section adapted to transport hot waste combustion gases, for recovering waste heat therefrom, comprising:

a. a plurality of thermal conduction members formed of solid extruded metal mounted side by side circumferentially around said duct, each of said thermal conduction members mounted longitudinally along said duct and having:

(1) a longitudinal surface which is transversely concavely arcuate and of substantially the same curvature in cross-section as that of said duct and adapted to be positioned in engagement with the surface of said duct, (2) a longitudinal channel opposite said concavely arcuate surface having a bottom which is concavely arcuate in cross-section and having a pair of spaced-apart lateral fins, b. a plurality of water pipes each having an outer surface of substantially the same curvature in cross-section of the bottoms of the channels of said thermal conduction members, one water pipe being disposed in the bottom of each of the said channels, in close contact engagement with the bottoms of said channels, the fins of each thermal conduction member being crimped over the water pipe contained therein and in contact engagement with substantially the entire surface thereof, and tightly securing said water pipe to said thermal conduction member, c. a plurality of U-shaped pipes connecting the ends of adjacent water pipes to provide a single continuous water conduit, said water conduit having means at one end adapted to be connected to a water source, and means at the other end adapted to be connected to the water inlet of said water heater.

2. An assembly according to claim 1, wherein said duct is an exhaust pipe.

3. an assembly according to claim 1, wherein said thermal conduction members are formed of extruded aluminum.

4. An assembly according to claim 1, wherein said water pipes and said U-shaped pipes are formed of copper.

5. An assembly according to claim 1, having an outer jacket.

* * * * *